US012031465B2

(12) United States Patent
Chinzei et al.

(10) Patent No.: US 12,031,465 B2
(45) Date of Patent: Jul. 9, 2024

(54) EXHAUST GAS PURIFICATION DEVICE

(71) Applicants: Isao Chinzei, Toyota (JP); Takumi Tojo, Miyoshi (JP); Masahide Miura, Toyota (JP); Nobusuke Kabashima, Toyota (JP); Minoru Ito, Kakegawa (JP); Naoto Fujita, Kakegawa (JP)

(72) Inventors: Isao Chinzei, Toyota (JP); Takumi Tojo, Miyoshi (JP); Masahide Miura, Toyota (JP); Nobusuke Kabashima, Toyota (JP); Minoru Ito, Kakegawa (JP); Naoto Fujita, Kakegawa (JP)

(73) Assignees: TOYOTA JIDOSHA KABUSHIKI KAISHA, Toyota (JP); CATALER CORPORATION, Kakegawa (JP)

( * ) Notice: Subject to any disclaimer, the term of this patent is extended or adjusted under 35 U.S.C. 154(b) by 0 days.

(21) Appl. No.: 17/487,236

(22) Filed: Sep. 28, 2021

(65) Prior Publication Data

US 2022/0106900 A1 Apr. 7, 2022

(30) Foreign Application Priority Data

Oct. 6, 2020 (JP) ..... 2020-169218

(51) Int. Cl.
*F01N 13/00* (2010.01)
*F01N 3/28* (2006.01)

(52) U.S. Cl.
CPC ..... *F01N 13/0097* (2014.06); *F01N 3/28* (2013.01); *F01N 3/2807* (2013.01);
(Continued)

(58) Field of Classification Search
CPC ..... F01N 3/28; F01N 13/0097; F01N 2510/0682; F01N 2510/0684
(Continued)

(56) References Cited

U.S. PATENT DOCUMENTS 8,153,549 B2 * 4/2012 Cho ..... B01J 37/0244 502/527.12
2007/0104632 A1 * 5/2007 Zuberi ..... F01N 3/035 423/213.2
(Continued)

FOREIGN PATENT DOCUMENTS

JP 2008279428 A 11/2008
JP 2016182586 A 10/2016
(Continued)

*Primary Examiner* — Jorge L Leon, Jr.
(74) *Attorney, Agent, or Firm* — Dickinson Wright, PLLC

(57) ABSTRACT

An exhaust gas purification device includes a substrate including an upstream end and a downstream end, the substrate having a length Ls between the upstream end and the downstream end; a first catalyst layer containing first catalyst particles, extending across a first region, and being in contact with the substrate, the first region extending between the upstream end and a first position, the first position being at a first distance La from the upstream end toward the downstream end; and a second catalyst layer containing second catalyst particles, extending across a second region, and being in contact with the substrate, the second region extending between the downstream end and a second position, the second position being at a second distance Lb from the downstream end toward the upstream end. The first catalyst layer has an inner surface defining macropores.

6 Claims, 4 Drawing Sheets

(52) U.S. Cl.
CPC ..... *F01N 3/2825* (2013.01); *F01N 13/0093* (2014.06); *F01N 2510/0682* (2013.01); *F01N 2510/0684* (2013.01)

(58) Field of Classification Search
USPC ..... 60/282, 299
See application file for complete search history.

(56) References Cited

U.S. PATENT DOCUMENTS

| | | | | |
|---|---|---|---|---|
| 2008/0254978 | A1 | 10/2008 | Kikuchi et al. | |
| 2010/0101212 | A1* | 4/2010 | Iwachido | B01D 53/945 60/299 |
| 2015/0202572 | A1* | 7/2015 | Chiffey | B01J 29/7015 502/241 |
| 2017/0087541 | A1* | 3/2017 | Andersen | B01J 29/763 |
| 2017/0189892 | A1* | 7/2017 | Yin | B01J 37/024 |
| 2017/0226905 | A1* | 8/2017 | Kabashima | F01N 3/103 |
| 2017/0284247 | A1* | 10/2017 | Kadoya | B01D 53/944 |
| 2018/0106175 | A1 | 4/2018 | Suzuki et al. | |
| 2018/0243728 | A1* | 8/2018 | Katoh | B01J 35/04 |
| 2018/0252132 | A1* | 9/2018 | Suzuki | B01J 35/1076 |
| 2019/0291083 | A1* | 9/2019 | Komata | B01J 37/10 |
| 2019/0299139 | A1* | 10/2019 | Tanaka | B01D 46/2429 |
| 2020/0384446 | A1 | 12/2020 | Kuno et al. | |
| 2021/0262373 | A1* | 8/2021 | Peng | F01N 3/2842 |
| 2022/0154621 | A1 | 5/2022 | Noguchi et al. | |

FOREIGN PATENT DOCUMENTS

| | | | |
|---|---|---|---|
| JP | 2016185493 | A | 10/2016 |
| JP | 2020157263 | A | 10/2020 |
| WO | 2019131796 | A1 | 7/2019 |

* cited by examiner

EXHAUST GAS PURIFICATION DEVICE

CROSS REFERENCE TO RELATED APPLICATIONS

The present application claims priority from Japanese patent application JP 2020-169218 filed on Oct. 6, 2020, the entire content of which is hereby incorporated by reference into this application.

BACKGROUND

Technical Field

The present disclosure relates to an exhaust gas purification device.

Background Art

An exhaust gas discharged from an internal combustion engine used in a vehicle, such as an automobile, contains a harmful substance, such as carbon monoxide (CO), hydrocarbon (HC), and nitrogen oxide (NOx). Regulations on emission amounts of these harmful substances have been tightened year by year. To remove these harmful substances, a noble metal, such as platinum (Pt), palladium (Pd), and rhodium (Rh), have been used as a catalyst.

JP 2008-279428 A discloses an exhaust gas purification catalyst that includes a catalyst layer provided with pores. JP 2008-279428 A discloses that the catalyst layer contains a catalyst powder containing a noble metal, and Pd and Rh are exemplified as the noble metal.

SUMMARY

Among the noble metals, for example, Rh has NOx reduction activity, and Pd and Pt have HC oxidation activity. It is desired that these noble metal catalysts are more effectively functioned to further reduce the emission of NOx and total hydrocarbons (THC). Therefore, the present disclosure provides an exhaust gas purification device with improved NOx conversion rate and THC conversion rate.

According to one aspect of the present disclosure, there is provided an exhaust gas purification device including:

- a substrate including an upstream end through which an exhaust gas is introduced into the device, and a downstream end through which the exhaust gas is discharged from the device, the substrate having a length Ls between the upstream end and the downstream end;
- a first catalyst layer containing first catalyst particles, extending across a first region, and being in contact with the substrate, the first region extending between the upstream end and a first position, the first position being at a first distance La from the upstream end toward the downstream end; and
- a second catalyst layer containing second catalyst particles, extending across a second region, and being in contact with the substrate, the second region extending between the downstream end and a second position, the second position being at a second distance Lb from the downstream end toward the upstream end,
- wherein the first catalyst layer has an inner surface defining macropores.

The exhaust gas purification device of the present disclosure shows a high NOx conversion rate and a high THC conversion rate.

DETAILED DESCRIPTION

Figure 1:
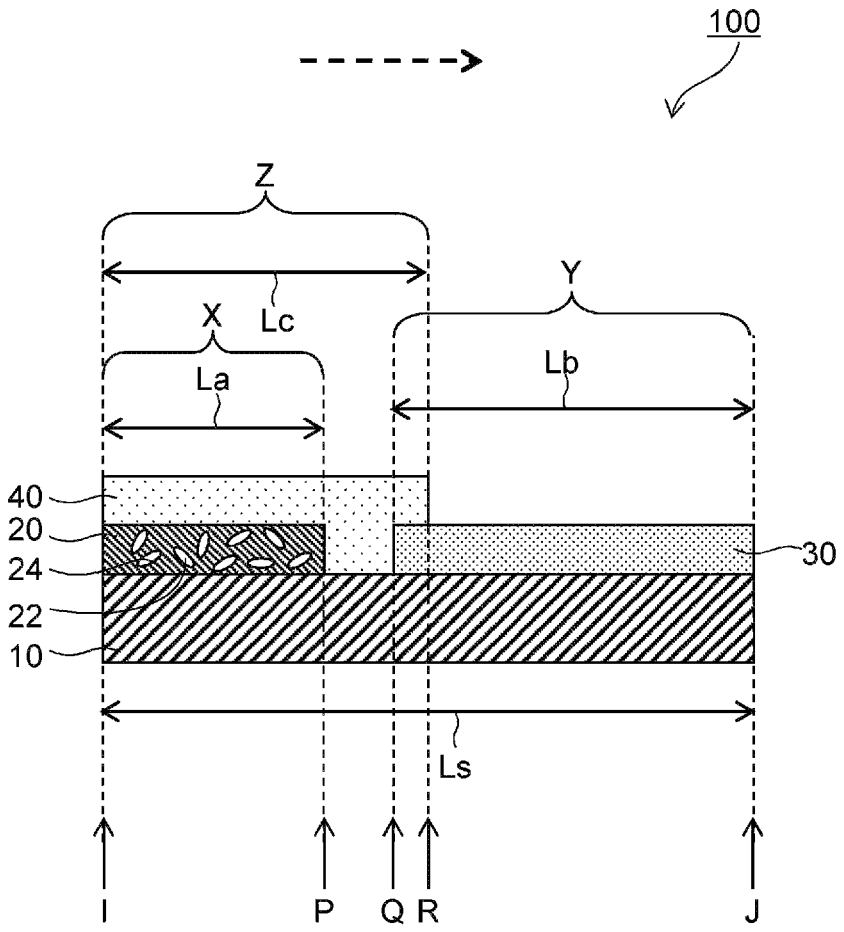
FIG. 1 is an enlarged end view of a main part of an exhaust gas purification device according to an embodiment taken along a surface parallel to a flow direction of an exhaust gas and schematically illustrating a configuration at a proximity of a partition wall of a substrate.

The following will describe embodiments of the present disclosure with reference to the drawings. In the drawings referred in the following description, same reference numerals are used for the same members or members having similar functions, and their repeated descriptions may be omitted in some cases. For convenience of explanation, a dimensional ratio in the drawings may differ from the actual ratio, and a part of a member may be omitted from the drawing in some cases. In this application, a numerical range expressed using the term "to" includes values described before and after the term "to" as the lower limit value and the upper limit value, respectively.

An exhaust gas purification device 100 according to the embodiment will be described with reference to FIGS. 1 and 2. The exhaust gas purification device 100 according to the embodiment includes a substrate 10, a first catalyst layer 20, a second catalyst layer 30, and a third catalyst layer 40. The third catalyst layer 40 is not indispensable.

(1) Substrate 10

The shape of the substrate 10 is not specifically limited. However, for example, as illustrated in FIG. 2, the substrate 10 may include a frame portion 12 and partition walls 16 that partition a space inside the frame portion 12 to define a plurality of cells 14. The frame portion 12 and the partition walls 16 may be integrally formed. The frame portion 12 may have any shape, such as a cylindrical shape, an elliptical cylindrical shape, or a polygonal cylindrical shape. The partition walls 16 extend between a first end (a first end surface) I and a second end (a second end surface) J of the substrate 10 to define the plurality of cells 14 extending between the first end I and the second end J. Each cell 14 may have any cross-sectional shape including: a quadrilateral shape, such as a square shape, a parallelogram, a rectangular shape, and a trapezoidal shape; a triangular shape; any polygonal shape (for example, a hexagonal shape and an octagonal shape); and a circular shape.

For example, the substrate 10 may be formed of a ceramic material having a high heat resistance, such as cordierite ($2MgO \cdot 2Al_2O_3 \cdot 5SiO_2$), alumina, zirconia, and silicon carbide, or a metal material formed of a metal foil, such as a stainless-steel foil. From an aspect of cost, the substrate 10 may be made of cordierite in some embodiments.

Figure 2:
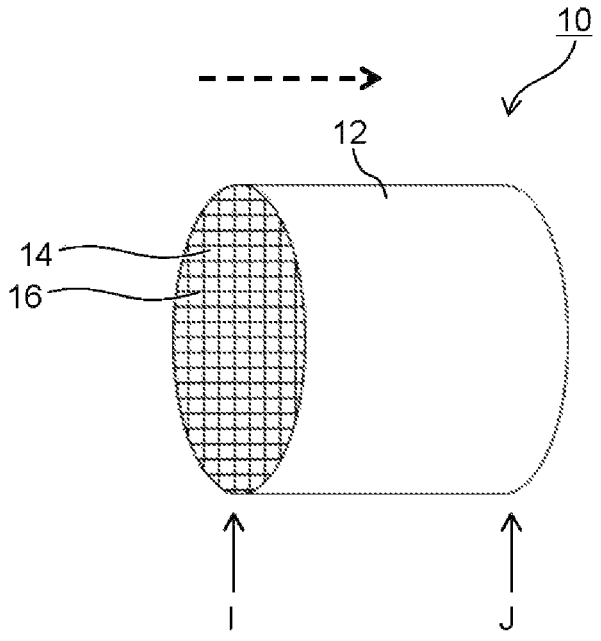
FIG. 2 is a perspective view schematically illustrating an example of the substrate.

In FIGS. 1 and 2, the dashed arrows indicate a flow direction of an exhaust gas in the exhaust gas purification device 100 and the substrate 10. The exhaust gas is introduced into the exhaust gas purification device 100 through the first end I, and discharged from the exhaust gas purification device 100 through the second end J. Therefore, hereinafter, the first end I will also be referred to as an upstream end I and the second end J will also be referred to as a downstream end J as necessary. In this specification, a length between the upstream end I and the downstream end J, that is, the total length of the substrate 10, is denoted as Ls.

(2) First Catalyst Layer 20

The first catalyst layer 20 is in contact with the substrate 10 and extends across a first region X extending between the upstream end I and a first position P, which is at a first distance La from the upstream end I toward the downstream end J (that is, in the flow direction of the exhaust gas). The first distance La may be from 15% to 50% of the total length Ls of the substrate 10. That is, the first distance La may be 0.15 Ls to 0.5 Ls.

The first catalyst layer 20 includes an inner surface 24 that defines macropores 22.

The macropores 22 may have an average pore diameter of 1 μm to 20 μm. With the macropores 22 having the average pore diameter of 1 μm or more, the exhaust gas can be sufficiently diffused in the entire first catalyst layer 20 through the macropores 22, thereby allowing the efficient purification of the exhaust gas. With the macropores 22 having the average pore diameter of 20 μm or less, the first catalyst layer 20 can have a sufficient strength, and it can be avoided that a volume of the first catalyst layer 20 increases more than necessary to increase the pressure loss. To diffuse the exhaust gas more efficiently in the entire first catalyst layer 20, the average pore diameter of the macropores may be 2 μm to 10 μm, and may be 3 μm to 10 μm.

The average pore diameter of the macropores 22 can be obtained as follows. A scanning electron microscope (SEM) is used to obtain reflected electron images of a plurality of any regions of 50 μm square in a surface or a cross-sectional surface of the first catalyst layer 20. The diameters of 20 or more given macropores 22 are obtained from the obtained reflected electron images, thus calculating the average value. Here, the diameter of the macropore 22 means the maximum value of the lengths of the macropore 22 in a direction perpendicular to a direction in which the macropore 22 has the longest length among the lengths of the macropore 22 measured in all directions in the reflected electron image (longitudinal direction of the macropore 22). When the macropores 22 are formed using a fibrous pore-forming material as described later, the macropores 22 observed in the reflected electron images generally have elongate shapes. Therefore, the average pore diameter of the macropores 22 can be obtained as described above with the maximum value of the lengths of the macropore in the direction perpendicular to the longitudinal direction of the macropore 22 being assumed as the diameter of the macropore 22.

The macropores 22 may have an average aspect ratio in a range of 9 to 40, an average aspect ratio in a range of 9 to 30 in some embodiments, and an average aspect ratio in a range of 9 to 28 in some embodiments. With the average aspect ratio of the macropores 22 in the above-described range, the exhaust gas can be diffused at an appropriate speed, thus allowing the efficient purification of the exhaust gas.

The average aspect ratio of the macropores 22 can be obtained as follows. The SEM is used to obtain reflected electron images of a plurality of any regions of 50 μm square in a surface or a cross-sectional surface of the first catalyst layer 20. The aspect ratios of 20 or more given macropores 22 are obtained from the obtained reflected electron images, thus calculating the average value. Here, the aspect ratio of the macropore 22 means a value of (length of macropore 22 in its longitudinal direction)/(maximum value of lengths of macropore 22 in direction perpendicular to the longitudinal direction of macropore 22).

The first catalyst layer 20 may have a porosity of 2 vol % to 30 vol %, and may have a porosity of 5 vol % to 20 vol % in some embodiments. With the porosity in the above-described range, the exhaust gas purification device 100 can have the satisfactory exhaust gas purification performance. The porosity of the first catalyst layer 20 can be measured by a method of mercury penetration or a gas adsorption measurement method, and also can be calculated by a three-dimensional analysis using a Focused Ion Beam-Scanning Electron Microscope (FIB-SEM), an X-ray CT, or the like.

The first catalyst layer 20 contains first catalyst particles. The first catalyst particles mainly function as a catalyst for oxidizing HC. The first catalyst particles may be particles of at least one metal selected from the group consisting of platinum (Pt), palladium (Pd), rhodium (Rh), ruthenium (Ru), osmium (Os), iridium (Ir), silver (Ag), gold (Au), and may be particles of at least one metal selected from Pt and Pd in some embodiments. The amount of the first catalyst particles contained in the first catalyst layer 20 may be, for example, 0.1 g/L to 10 g/L based on a substrate capacity in the first region X, may be 1 g/L to 9 g/L based on a substrate capacity in the first region X in some embodiments, and may be 3 g/L to 7 g/L based on a substrate capacity in the first region X in some embodiments. This allows the exhaust gas purification device 100 to have a sufficiently high exhaust gas purification performance.

As described above, since the exhaust gas can be sufficiently diffused in the entire first catalyst layer 20 through the macropores 22, the exhaust gas can contact the first catalyst particles in the first catalyst layer 20 at sufficient frequency and probability, which allows efficient oxidization of HC in the exhaust gas. Accordingly, the exhaust gas purification device 100 can have a high THC conversion rate. Furthermore, effective oxidization and removal of HC in the first catalyst layer 20 can prevent or reduce the reduction of an NOx conversion performance of the second catalyst particles which may be caused by HC coating formation on the second catalyst particles in the second catalyst layer 30. This allows the exhaust gas purification device 100 to also have a high NOx conversion rate.

The first catalyst particles may be supported on carrier particles. The carrier particles are not specifically limited. For example, oxide carrier particles are usable as the carrier particles. The first catalyst particles can be supported by any supporting method such as an impregnation supporting method, an adsorption supporting method, and a water-absorption supporting method.

Examples of the oxide carrier particles include particles of metal oxide, for example, particles of oxide of one or more metals selected from the group consisting of Group 3, Group 4, and Group 13 of the periodic table of elements, and lanthanoid-based metals. When the oxide carrier particles are particles of oxide of two or more metals, the oxide carrier particles may be a mixture of two or more metal oxides, may be composite oxide containing two or more metals, or may be a mixture of one or more metal oxides and one or more composite oxides.

For example, the metal oxide may be oxide of one or more metals selected from the group consisting of scandium (Sc), yttrium (Y), lanthanum (La), cerium (Ce), neodymium (Nd), samarium (Sm), europium (Eu), lutetium (Lu), titanium (Ti), zirconium (Zr), and aluminum (Al). The metal oxide may be oxide of one or more metals selected from the group consisting of Y, La, Ce, Ti, Zr, and Al in some embodiments. Especially, the metal oxide may be alumina ($Al_2O_3$) or composite oxide of $Al_2O_3$ and lanthana ($La_2O_3$).

The amount of the carrier particles contained in the first catalyst layer 20 may be, for example, from 1 g/L to 100 g/L based on the substrate capacity in the first region X, may be from 10 g/L to 90 g/L based on the substrate capacity in the first region X in some embodiments, and may be from 30 g/L to 70 g/L based on the substrate capacity in the first region X in some embodiments. This allows the exhaust gas purification device 100 to have a sufficiently high exhaust gas purification performance. The particle sizes of the carrier particles are not specifically limited and may be appropriately set.

With the use of the first catalyst particles supported on the carrier particles, the amount of the supported first catalyst particles may be, for example, 40 weight % or less, 30 weight % or less, 20 weight % or less, 15 weight % or less, 13 weight % or less, or 11 weight % or less based on the weight of the carrier particles, and the amount of the supported first catalyst particles may be, for example, 0.1 weight % or more, 0.5 weight % or more, 1 weight % or more, 5 weight % or more, 7 weight % or more, or 9 weight % or more based on the weight of the carrier particles.

The first catalyst layer 20 may further contain another optional ingredient. Examples of another optional ingredient include an Oxygen Storage Capacity (OSC) material that occludes oxygen in the atmosphere under oxygen excess atmosphere and releases oxygen under oxygen deficient atmosphere.

The OSC material is not specifically limited, and examples of which include cerium oxide (ceria: $CeO_2$), composite oxide containing ceria (for example, ceria-zirconia ($ZrO_2$) composite oxide (CZ or ZC composite oxide), and alumina ($Al_2O_3$)-ceria-zirconia composite oxide (ACZ composite oxide)). Especially, because of high oxygen storage capacity and relatively low-price, CZ composite oxide may be used in some embodiments. CZ composite oxide further combined with lanthana ($La_2O_3$), yttria ($Y_2O_3$), or the like can also be used as an OSC material. A weight ratio of ceria to zirconia in ceria-zirconia composite oxide $CeO_2/ZrO_2$ may be 0.1 to 1.0.

The amount of the OSC material contained in the first catalyst layer 20 may be, for example, from 1 g/L to 100 g/L based on the substrate capacity in the first region X, may be from 10 g/L to 90 g/L based on the substrate capacity in the first region X in some embodiments, and may be from 30 g/L to 70 g/L based on the substrate capacity in the first region X in some embodiments. This allows the exhaust gas purification device 100 to have a sufficiently high exhaust gas purification performance.

The first catalyst layer 20 can be formed as follows, for example.

First, a slurry containing a pore-forming material, a first catalyst particle precursor, and carrier powder is prepared. Alternatively, a slurry containing a pore-forming material and carrier powder on which the first catalyst particles are preliminarily supported may be prepared. The slurry may further contain an OSC material, a binder, an additive, or the like. Properties of the slurry, for example, viscosity and a particle diameter of a solid component may be appropriately adjusted. The prepared slurry is applied to the substrate 10 in the first region X. For example, the substrate 10 is dipped in the slurry from the upstream end I up to a depth corresponding to the first distance La, and after a predetermined time has passed, the substrate 10 is drawn from the slurry, thus allowing the substrate 10 in the first region X to be coated with the slurry. Alternatively, the slurry may be poured through the upstream end I of the substrate 10 into the cells 14, and a blower may blow the upstream end I to spread the slurry toward the downstream end J, thus allowing the substrate 10 to be coated with the slurry. Next, the slurry is heated at a predetermined temperature for a predetermined period, thus drying and sintering the slurry. Thus, a solvent in the slurry is vaporized, and the pore-forming material is dissipated. When the pore-forming material is dissipated, macropores having the shapes corresponding to the shapes of the pore-forming material are formed at portions where the pore-forming material existed. Accordingly, the first catalyst layer 20 having the inner surface defining the macropores and being in contact with the substrate 10 is formed in the first region X. From a perspective of avoiding remaining of the residual pore-forming material, the heating of the slurry may be performed in the atmosphere at the temperature of 300° C. to 800° C., and may be performed in the atmosphere at the temperature of 400° C. to 700° C. in some embodiments. The heating of the slurry may be performed for 20 minutes or more, and may be performed for 30 minutes to two hours. The heating of the slurry may be performed in the air or in an inert gas, such as nitrogen.

As the pore-forming material, a fibrous pore-forming material may be used. Examples of the fibrous pore-forming material include a polyethylene terephthalate (PET) fiber, an acrylic fiber, a nylon fiber, a rayon fiber, a cellulose fiber. From a perspective of a balance between workability and sintering temperature (dissipation temperature), the pore-forming material may be at least one selected from the group consisting of the PET fiber and the nylon fiber.

The fibrous pore-forming material may have an average diameter (average fiber diameter) of 1 μm to 20 μm, an average diameter of 2 μm to 10 μm in some embodiments, and an average diameter of 3 μm to 10 μm in some embodiments. The average diameter in the above-described range allows formation of the macropores each having a size appropriate for the gas diffusion. The average diameter of the fibrous pore-forming material is determined by measuring the fiber diameters of randomly selected 50 pieces or more of the fibrous pore-forming material and calculating the average.

The fibrous pore-forming material may have an average aspect ratio in a range of 9 to 40, an average aspect ratio in a range of 9 to 30 in some embodiments, and an average aspect ratio in a range of 9 to 28 in some embodiments. With the average aspect ratio in the above-described range, the macropores each having an appropriate size that allows the exhaust gas diffusion at an appropriate speed are formed, which leads to the exhaust gas purification device 100 that can efficiently purify the exhaust gas. Here, the average aspect ratio of the fibrous pore-forming material is defined as (average fiber length)/(average diameter (average fiber diameter)). The fiber length means a linear distance between both ends of the fiber, and the average fiber length is determined by measuring the fiber lengths of randomly selected 50 pieces or more of the fibrous pore-forming material and calculating the average value.

As the first catalyst particle precursor, an appropriate inorganic acid salt, such as hydrochloride salt, nitrate salt, phosphate salt, sulfate salt, borate salt, and hydrofluoride salt, of the metal constituting the first catalyst particles can be used.

(3) Second Catalyst Layer 30

The second catalyst layer 30 is in contact with the substrate 10 and extends across a second region Y extending between the downstream end J and a second position Q, which is at a second distance Lb from the downstream end J toward the upstream end I (that is, in a direction opposite to the flow direction of the exhaust gas). The second distance Lb may be from 40% to 70% of the total length Ls of the substrate 10. That is, the second distance Lb may be 0.4 Ls to 0.7 Ls.

The second catalyst layer 30 contains second catalyst particles. The second catalyst particles mainly function as a catalyst for reducing NOx. The second catalyst particles may be particles of at least one metal selected from the group consisting of rhodium (Rh), platinum (Pt), palladium (Pd), ruthenium (Ru), osmium (Os), iridium (Ir), silver (Ag), gold (Au), and especially may be Rh particles. The metal constituting the second catalyst particles may be different from the metal constituting the first catalyst particles. The amount of the second catalyst particles contained in the second catalyst layer 30 may be, for example, 0.05 g/L to 5 g/L, 0.1 g/L to 2.5 g/L, 0.2 g/L to 1.2 g/L, or 0.4 g/L to 0.6 g/L based on a substrate capacity in the second region Y. This allows the exhaust gas purification device 100 to have a sufficiently high exhaust gas purification performance.

The second catalyst particles may be supported on carrier particles. The carrier particles are not specifically limited. For example, oxide carrier particles are usable as the carrier particles. The second catalyst particles can be supported by any supporting method such as an impregnation supporting method, an adsorption supporting method, and a water-absorption supporting method.

Examples of the oxide carrier particles include particles of metal oxide, for example, particles of oxide of one or more metals selected from the group consisting of Group 3, Group 4, and Group 13 of the periodic table of elements, and lanthanoid-based metals. When the oxide carrier particles are particles of oxide of two or more metals, the oxide carrier particles may be a mixture of two or more metal oxides, may be composite oxide containing two or more metals, or may be a mixture of one or more metal oxides and one or more composite oxides.

For example, the metal oxide may be oxide of one or more metals selected from the group consisting of scandium (Sc), yttrium (Y), lanthanum (La), cerium (Ce), neodymium (Nd), samarium (Sm), europium (Eu), lutetium (Lu), titanium (Ti), zirconium (Zr), and aluminum (Al). The metal oxide may be oxide of one or more metals selected from the group consisting of Y, La, Ce, Ti, Zr, and Al in some embodiments. Especially, the metal oxide may be composite oxide of alumina, ceria, and zirconia. A trace amount of yttria, lanthana, and neodymium oxide ($Nd_2O_3$) may be added to the composite oxide of alumina, ceria, and zirconia to improve a heat resistance.

The amount of the carrier particles contained in the second catalyst layer 30 may be, for example, from 1 g/L to 100 g/L based on the substrate capacity in the second region Y, may be from 10 g/L to 90 g/L based on the substrate capacity in the second region Y in some embodiments, and may be from 30 g/L to 70 g/L based on the substrate capacity in the second region Y in some embodiments. This allows the exhaust gas purification device 100 to have a sufficiently high exhaust gas purification performance. The particle sizes of the carrier particles are not specifically limited and may be appropriately set.

With the use of the second catalyst particles supported on the carrier particles, the amount of the supported second catalyst particles may be, for example, 7 weight % or less, 5 weight % or less, 3 weight % or less, 2 weight % or less, 1.5 weight % or less, or 1.2 weight % or less based on the weight of the carrier particles, and the amount of the supported second catalyst particles may be, for example, 0.01 weight % or more, 0.02 weight % or more, 0.05 weight % or more, 0.07 weight % or more, 0.1 weight % or more, 0.2 weight % or more, 0.5 weight % or more, or 0.9 weight % or more based on the weight of the carrier particles.

The second catalyst layer 30 may further contain another optional ingredient. Examples of another optional ingredient include an OSC material.

The OSC material is not specifically limited, and examples of which include ceria and composite oxide containing ceria (for example, CZ composite oxide and ACZ composite oxide). Especially, because of high oxygen storage capacity and relatively low-price, CZ composite oxide may be used in some embodiments. CZ composite oxide further combined with lanthana ($La_2O_3$), yttria ($Y_2O_3$), or the like can also be used as an OSC material. A weight ratio of the ceria to the zirconia in the ceria-zirconia composite oxide $CeO_2/ZrO_2$ may be 0.1 to 1.0.

The amount of the OSC material contained in the second catalyst layer 30 may be, for example, from 10 g/L to 200 g/L based on the substrate capacity in the second region Y, may be from 50 g/L to 150 g/L based on the substrate capacity in the second region Y in some embodiments, and may be from 80 g/L to 120 g/L based on the substrate capacity in the second region Y in some embodiments. This allows the exhaust gas purification device 100 to have a sufficiently high exhaust gas purification performance.

The second catalyst layer 30 can be formed, for example, as follows. First, a slurry containing second catalyst particle precursor and carrier powder is prepared. Alternatively, a slurry containing carrier powder on which the second catalyst particles are preliminarily supported may be prepared. The slurry may further contain an OSC material, a binder, an additive, or the like. Properties of the slurry, for example, viscosity and a particle diameter of a solid component may be appropriately adjusted. The prepared slurry is applied to the substrate 10 in the second region Y. For example, the substrate 10 is dipped in the slurry from the downstream end J up to a depth corresponding to the second distance Lb, and after a predetermined time has passed, the substrate 10 is drawn from the slurry, thus allowing the substrate 10 in the second region Y to be coated with the slurry. Alternatively, the slurry may be poured through the downstream end J of the substrate 10 into the cells 14, and blower may blow the downstream end J to spread the slurry toward the upstream end I, thus allowing the substrate 10 to be coated with the slurry. Next, the slurry is heated at a predetermined temperature for a predetermined time, thus drying and sintering the slurry. Thus, the second catalyst layer 30 in contact with the substrate 10 is formed in the second region Y.

As the second catalyst particle precursor, an appropriate inorganic acid salt, such as hydrochloride salt, nitrate salt, phosphate salt, sulfate salt, borate salt, and hydrofluoride salt, of the metal constituting the second catalyst particles can be used.

(4) Third Catalyst Layer 40

The third catalyst layer 40 is in contact with at least the first catalyst layer 20 and extends across a third region Z extending between the upstream end I and a third position R, which is at a third distance Lc from the upstream end I toward the downstream end J (that is, in the flow direction of the exhaust gas). The third distance Lc may be from 40% to 70% of the total length Ls of the substrate 10. That is, the third distance Lc may be 0.4 Ls to 0.7 Ls.

The third catalyst layer 40 contains third catalyst particles. The third catalyst particles mainly function as a catalyst for reducing NOx. The third catalyst particles may be particles of at least one metal selected from the group consisting of rhodium (Rh), platinum (Pt), palladium (Pd), ruthenium (Ru), osmium (Os), iridium (Ir), silver (Ag), gold (Au), and especially may be Rh particles. The metal constituting the third catalyst particles may be different from the metal constituting the first catalyst particles, and may be the same as the metal constituting the second catalyst particles. The amount of the third catalyst particles contained in the third catalyst layer 40 may be, for example, 0.02 g/L to 2 g/L, 0.05 g/L to 0.7 g/L, or 0.2 g/L to 0.4 g/L based on a substrate capacity in the third region Z. This allows the exhaust gas purification device 100 to have a sufficiently high exhaust gas purification performance.

The third catalyst particles may be supported on carrier particles. The carrier particles are not specifically limited. For example, oxide carrier particles are usable as the carrier particles. The third catalyst particles can be supported by any supporting method such as an impregnation supporting method, an adsorption supporting method, and a water-absorption supporting method.

As the oxide carrier particles, a material similar to the material usable for the second catalyst layer 30 can be used.

The amount of the carrier particles contained in the third catalyst layer 40 may be, for example, more than 0 g/L and 100 g/L or less, more than 0 g/L and 50 g/L or less, more than 0 g/L and 35 g/L or less, more than 0 g/L and less than 33 g/L, 10 g/L or more and 30 g/L or less, or 13 g/L or more and 27 g/L or less based on the substrate capacity in the third region Z. This allows the exhaust gas purification device 100 to have a sufficiently high exhaust gas purification performance. The particle size of carrier particle is not specifically limited, and may be appropriately set.

With the use of the third catalyst particles supported on the carrier particles, the amount of the supported third catalyst particles may be, for example, 7 weight % or less, 5 weight % or less, or 4 weight % or less based on the weight of the carrier particles, and the amount of the supported third catalyst particles may be, for example, 0.1 weight % or more, 0.5 weight % or more, 1.0 weight % or more, 1.5 weight % or more, or 1.8 weight % or more based on the weight of the carrier particles.

The third catalyst layer 40 may further contain another optional ingredient. Examples of another optional ingredient include an OSC material.

As the OSC material, the OSC material described in the section of "(3) Second Catalyst Layer 30" can be used.

The amount of the OSC material contained in the third catalyst layer 40 may be, for example, more than 0 g/L and 200 g/L or less, more than 0 g/L and 100 g/L or less, more than 0 g/L and 70 g/L or less, more than 0 g/L and less than 66 g/L, 20 g/L or more and 60 g/L or less, or 26 g/L or more and 54 g/L or less based on the substrate capacity in the third region Z. This allows the exhaust gas purification device 100 to have a sufficiently high exhaust gas purification performance.

As described above, in the exhaust gas purification device 100, the third catalyst layer 40 is not indispensable. However, the third catalyst layer 40 disposed at the proximity of the upstream end I through which the high temperature exhaust gas introduced when the exhaust gas purification device 100 is used allows the third catalyst particles in the third catalyst layer 40 to be heated by the high temperature exhaust gas, leading to enhancement of the NOx reduction activity of the third catalyst particles. Therefore, providing the third catalyst layer 40 allows the improvement of the NOx conversion rate. As described in examples below, the total mass of the third catalyst layer 40 may be more than 0 g/L and less than 100 g/L, 20 g/L to 90 g/L, or 40 g/L to 80 g/L based on a capacity of the substrate in the third region Z. This allows achieving an improvement of both of the NOx conversion rate and the THC conversion rate in the exhaust gas purification device 100.

The third catalyst layer 40 can be formed, for example, as follows. First, a slurry containing a third catalyst particle precursor and carrier powder is prepared. Alternatively, a slurry containing carrier powder on which the third catalyst particles are preliminarily supported may be prepared. The slurry may further contain an OSC material, a binder, an additive, or the like. Properties of the slurry, for example, viscosity and a particle diameter of a solid component may be appropriately adjusted. The prepared slurry is applied to the substrate 10, on which at least the first catalyst layer 20 is formed, in the third region Z. For example, the substrate 10 is dipped in the slurry from the upstream end I up to a depth corresponding to the third distance Lc, and after a predetermined time has passed, the substrate 10 is drawn from the slurry, thus allowing the slurry to be applied at least on the first catalyst layer 20 in the third region Z. Alternatively, the slurry may be poured through the upstream end I of the substrate 10 into the cells 14, and blower may blow the upstream end I to spread the slurry toward the downstream end J, thus allowing the slurry to be applied at least on the first catalyst layer 20. Next, the slurry is heated at a predetermined temperature for a predetermined time, thus drying and sintering the slurry. Thus, the third catalyst layer 40 in contact with at least the first catalyst layer 20 is formed in the third region Z.

Figure 3:
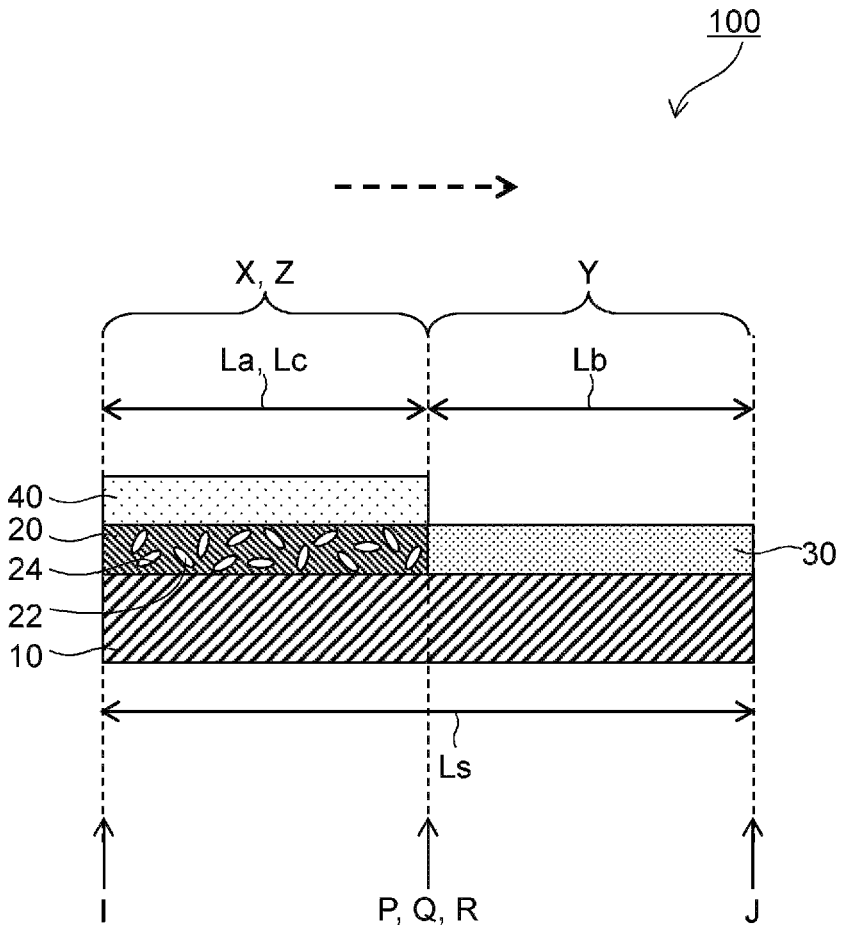
FIG. 3 is an enlarged end view of a main part of an exhaust gas purification device according to a modified embodiment taken along a surface parallel to a flow direction of an exhaust gas and schematically illustrating a configuration at a proximity of a partition wall of a substrate.

The third catalyst layer 40 may be formed either before or after the second catalyst layer 30 is formed. In addition, FIG. 1 merely shows one of the examples of how the first catalyst layer 20, the second catalyst layer 30, and the third catalyst layer 40 are overlapped. For example, as a modification illustrated in FIG. 3, the first position P, the second position Q, and the third position R may be set at the same position.

The exhaust gas purification device 100 according to the embodiment is applicable to various vehicles that include internal combustion engines.

While the embodiments of the present disclosure have been described in detail above, the present disclosure is not limited thereto, and can be subjected to various kinds of changes in design without departing from the spirit or scope of the present disclosure described in the claims.

EXAMPLES

The following will specifically describe the present disclosure with the examples, but the present disclosure is not limited to these examples.

(1) Materials Used in Examples and Comparative Examples a) Substrate (Honeycomb Substrate)

Material: Cordierite

Capacity: 875 cc

Thickness of Partition Wall: 2 mil (50.8 μm)

Cell Density: 600 pieces per square inch

Cross-Sectional Shape of Cell: Hexagon b) Material 1

Composite of $Al_2O_3$ and $La_2O_3$ ($La_2O_3$: 1 wt % to 10 wt %)

c) Material 2

A material produced by adding trace amounts of $Nd_2O_3$, $La_2O_3$, and $Y_2O_3$ to ACZ ($Al_2O_3$—$CeO_2$—$ZrO_2$) composite oxide ($CeO_2$: 15 to 30 wt %) and treating the resultant to increase its heat resistance d) Material 3

CZ ($CeO_2$—$ZrO_2$) composite oxide ($CeO_2$: 40 wt %, $ZrO_2$: 50 wt %, $La_2O_3$: 5 wt %, $Y_2O_3$: 5 wt %)

e) Material 4

CZ ($CeO_2$—$ZrO_2$) composite oxide ($CeO_2$: 20 wt %, $ZrO_2$: 70 wt %, $La_2O_3$: 5 wt %, $Y_2O_3$: 5 wt %)

f) Material 5

Palladium nitrate g) Material 6

Rhodium nitrate h) Material 7

Barium sulfate (2) Manufacturing Exhaust Gas Purification Device

Examples 1 to 3

While distilled water was stirred, the material 1, the material 3, the material 5, the material 7, an $Al_2O_3$-based binder, and a polyethylene terephthalate fiber as a fibrous pore-forming material were added to the distilled water to prepare a suspended slurry 1. The prepared slurry 1 was poured through one end (upstream end) of the substrate into the cells, and excess slurry was blown off with a blower. Consequently, the partition wall of the substrate was coated with the slurry 1 in the first region extending between the one end of the substrate and the first position, which was at a distance of 50% of the substrate total length of the substrate from the one end of the substrate toward the other end (downstream end) of the substrate. The substrate was placed in a drying machine whose inside was held at 120° C. for two hours to vaporize water contained in the slurry 1. Next, the substrate was baked in an electric furnace at 500° C. for two hours. Thus, a first catalyst layer was formed.

At this time, the amount of the material 1 contained in the first catalyst layer was 50 g/L based on the capacity of the substrate in the first region, the amount of the material 3 contained in the first catalyst layer was 50 g/L based on the capacity of the substrate in the first region, the amount of Pd particles contained in the first catalyst layer as the first catalyst particles derived from the material 5 was 5 g/L based on the capacity of the substrate in the first region, and the amount of the material 7 contained in the first catalyst layer was 5 g/L based on the capacity of the substrate in the first region.

Next, while distilled water was stirred, the material 1, the material 2, the material 4, the material 6, and the $Al_2O_3$-based binder were added to the distilled water to prepare a suspended slurry 2. The prepared slurry 2 was poured through the other end (downstream end) of the substrate into the cells, and excess slurry was blown off with a blower. Consequently, the partition wall of the substrate was coated with the slurry 2 in the second region extending between the other end of the substrate and the second position, which was at a distance of 50% of the substrate total length from the other end of the substrate toward the one end (upstream end) of the substrate. The substrate was placed in a drying machine whose inside was held at 120° C. for two hours to vaporize water contained in the slurry 2. Next, the substrate was baked in an electric furnace at 500° C. for two hours. Thus, a second catalyst layer was formed.

At this time, the amount of the material 1 contained in the second catalyst layer was 50 g/L based on the capacity of the substrate in the second region, the amount of the material 2 contained in the second catalyst layer was 50 g/L based on the capacity of the substrate in the second region, the amount of the material 4 contained in the second catalyst layer was 50 g/L based on the capacity of the substrate in the second region, and the amount of Rh particles contained in the second catalyst layer as the second catalyst particles derived from the material 6 was 0.5 g/L based on the capacity of the substrate in the second region.

Next, while distilled water was stirred, the material 1, the material 2, the material 4, the material 6, and the $Al_2O_3$-based binder were added to the distilled water to prepare a suspended slurry 3. The prepared slurry 3 was poured through one end (upstream end) of the substrate into the cells, and excess slurry was blown off with a blower. Consequently, a layer of the slurry 3 was formed in the third region extending the one end of the substrate and the third position, which was at a distance of 50% of the substrate total length from the one end of the substrate toward the other end (downstream end) of the substrate. The substrate was placed in a drying machine whose inside was held at 120° C. for two hours to vaporize water contained in the slurry 3. Next, the substrate was baked in an electric furnace at 500° C. for two hours. Thus, a third catalyst layer was formed.

At this time, the total mass (total application amount) of the third catalyst layer, the amounts of the material 1 contained in the third catalyst layer, the material 2 contained in the third catalyst layer, the material 4 contained in the third catalyst layer, and Rh particles contained in the third catalyst layer as the third catalyst particles derived from the material 6, each of which is based on a capacity of the substrate in the third region, were as described in Table 1.

Example 4

An exhaust gas purification device was manufactured similarly to Examples 1 to 3 except that the amount of Rh derived from the material 6 and contained in the second catalyst layer was set to 1.0 g/L based on a capacity of the substrate in the second region, and that the third catalyst layer was not formed.

Comparative Examples 1 to 3

Exhaust gas purification devices of Comparative Examples 1, 2, and 3 were manufactured similarly to Examples 4, 3, and 1, respectively, except that the fibrous pore-forming material was not used in the formation of the first catalyst layer.

(3) Exhaust Gas Purification Performance Evaluation

The exhaust gas purification devices of Examples 1 to 4 and Comparative Examples 1 to 3 were each coupled to an exhaust system of a V-8 engine. While a stoichiometric mixture of air and fuel (an air-fuel ratio A/F=14.6) and a mixture containing excess oxygen (lean: A/F>14.6) were introduced into the engine alternately with a time ratio of 3:1 in a fixed cycle, a bed temperature of each of the exhaust gas purification devices was maintained at 950° C. for 50 hours. Thus, each of the exhaust gas purification devices was aged.

Next, the exhaust gas purification devices were each coupled to an exhaust system of an L-4 engine. An air-fuel mixture with an air-fuel ratio A/F of 14.4 was supplied to the engine, and an operation condition of the engine was controlled such that a temperature of an exhaust gas introduced into each of the exhaust gas purification devices be 550° C.

NOx content in the gas introduced into each of the exhaust gas purification devices and NOx content in the gas discharged from each of the exhaust gas purification devices were measured to calculate (the NOx content in the gas discharged from the exhaust gas purification device)/(the NOx content in the gas introduced into the exhaust gas purification device) as a NOx conversion rate. Additionally, total hydrocarbons (THC) content in the gas introduced into each of the exhaust gas purification device and total hydrocarbons (THC) content in the gas discharged from each of the exhaust gas purification devices were measured to calculate (the THC content in the gas discharged from the exhaust gas purification device)/(the THC content in the gas introduced into the exhaust gas purification device) as a THC conversion rate. Table 1 and FIG. 4 show the results.

In a comparison between Example 4 and Comparative Example 1, in both of which the third catalyst layer was not disposed, the exhaust gas purification device of Example 4 exhibited the higher NOx conversion rate and the higher THC conversion rate. This is considered to be caused by the following reason. That is, since the first catalyst layer of Example 4 was formed by using the pore-forming material, the macropores were provided in the first catalyst layer. Consequently, the Pd particles in the first catalyst layer efficiently functioned as the catalyst for the HC conversion, thus providing the high THC conversion rate. Furthermore, the high THC conversion rate in the first catalyst layer prevented or reduced HC coating formation on the Rh particles in the second catalyst layer, and consequently prevented or reduced the reduction of the NOx conversion performance of the Rh particles, thus resulting in the high NOx conversion rate.

Figure 4:
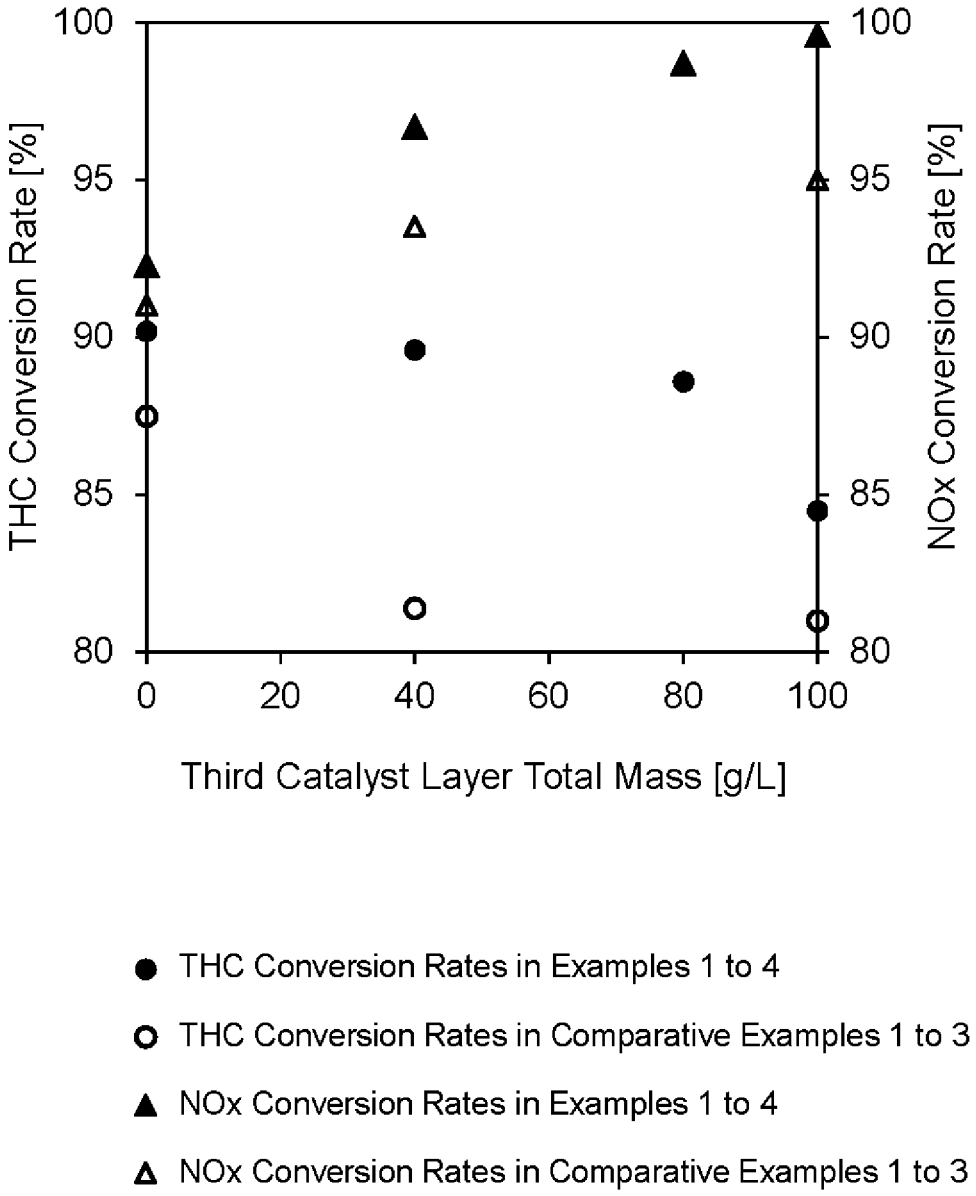
FIG. 4 is a graph illustrating NOx conversion rates and total THC conversion rates of exhaust gas purification devices of examples and comparative examples.

As illustrated in FIG. 4, the more the total mass of the third catalyst layer was, the more the NOx conversion rate improved, while the more the THC conversion rate decreased. It is considered that the increase of the total mass of the third catalyst layer decreased an exhaust gas permeability of the third catalyst layer, which caused the exhaust gas to be less likely to contact the Pd particles in the first catalyst layer, resulting in the decrease of the THC conversion rate. Actually, the THC conversion rate of Comparative Example 2 in which the pore-forming material was not used in the formation of the first catalyst layer and the total mass of the third catalyst layer was 40 g/L significantly lower than the THC conversion rate of Comparative Example 1 in which the pore-forming material was not used in the formation of the first catalyst layer and the total mass of the third catalyst layer was 0 g/L. However, in contrast, as illustrated in FIG. 4, in Examples 1 to 4 in which the pore-forming material was used in the formation of the first catalyst layer, when the total mass of the third catalyst layer was less than 100 g/L, especially 90 g/L or less, particularly 80 g/L or less, the decrease of the THC conversion rate associated with the increase of the total mass of the third catalyst layer was small. This indicates that the macropores in the first catalyst layer reduced the decrease of the THC conversion rate associated with the increase of the total mass of the third catalyst layer. As illustrated in FIG. 4, when the total mass of the third catalyst layer was more than 0 g/L and less than 100 g/L, 20 g/L to 90 g/L, or 40 g/L to 80 g/L, the especially high THC conversion rate was achieved.

TABLE 1

| | Second Catalyst Layer | Third Catalyst Layer | | | | | THC | NOx |
|---|---|---|---|---|---|---|---|---|
| | Rh Particle Content [g/L] | Total Mass [g/L] | Material 1 Content [g/L] | Material 2 Content [g/L] | Material 4 Content [g/L] | Rh Particle Content [g/L] | Conversion Rate [%] | Conversion Rate [%] |
| Example 1 | 0.5 | 100 | 33 | 33 | 33 | 0.5 | 84.5 | 99.6 |
| Example 2 | 0.5 | 80 | 27 | 27 | 27 | 0.5 | 88.6 | 98.7 |
| Example 3 | 0.5 | 40 | 13 | 13 | 13 | 0.5 | 89.6 | 96.7 |
| Example 4 | 1 | 0 | 0 | 0 | 0 | 0 | 90.2 | 92.3 |
| Comparative Example 1 | 1 | 0 | 0 | 0 | 0 | 0 | 87.5 | 91 |
| Comparative Example 2 | 0.5 | 40 | 13 | 13 | 13 | 0.5 | 81.4 | 93.5 |
| Comparative Example 3 | 0.5 | 100 | 33 | 33 | 33 | 0.5 | 81.0 | 95 |

What is claimed is:

1. An exhaust gas purification device comprising:

a substrate including an upstream end through which an exhaust gas is introduced into the device, and a downstream end through which the exhaust gas is discharged from the device, the substrate having a length (Ls) extending from the upstream end to the downstream end;

a first catalyst layer containing first catalyst particles, extending across a first region, and being in contact with the substrate, the first region extending from the upstream end to a first position, the first position being at a first distance (La) from the upstream end toward the downstream end;

a second catalyst layer containing second catalyst particles, extending across a second region, and being in contact with the substrate, the second region extending from the downstream end to a second position, the second position being at a second distance (Lb) from the downstream end toward the upstream end, wherein the second position is a same position as the first position; and a third catalyst layer containing third catalyst particles, extending across a third region, and being in contact with at least the first catalyst layer, the third region extending from the upstream end to a third position, the third position being at a third distance (Lc) from the upstream end toward the downstream end, wherein the third distance (Lc) is 40% to 70% of the length (Ls) of the substrate;

wherein the third catalyst particles are particles that function as a catalyst for reducing NOx, wherein the first catalyst layer has an inner surface defining macropores, wherein a total mass of the third catalyst layer is 40 g/L based on a capacity of the substrate in the third region;

wherein the first catalyst particles comprise palladium;

wherein the second catalyst particles comprise rhodium; and wherein the third catalyst particles comprise rhodium.

2. The exhaust gas purification device according to claim 1, wherein the first distance (La) is 15% to 50% of the length (Ls) of the substrate.

3. The exhaust gas purification device according to claim 1, wherein the second distance (Lb) is 40% to 70% of the length (Ls) of the substrate.

4. The exhaust gas purification device according to claim 1, wherein the third position is at the same position as the first position and the second position.

5. The exhaust gas purification device according to claim 4, wherein the third distance (Lc) is 50% of the length (Ls) of the substrate.

6. The exhaust gas purification device according to claim 1, wherein the first catalyst layer has a porosity of 2 vol % to 30 vol %.

* * * * *